US010557611B2

(12) United States Patent
Sugiyama et al.

(10) Patent No.: US 10,557,611 B2
(45) Date of Patent: Feb. 11, 2020

(54) METHOD FOR ADJUSTING OUTPUT LIGHT COLOR OF VEHICULAR HEADLAMP UNIT

(71) Applicant: STANLEY ELECTRIC CO., LTD., Tokyo (JP)

(72) Inventors: Takashi Sugiyama, Tokyo (JP); Tsuyoshi Maruyama, Tokyo (JP)

(73) Assignee: STANLEY ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 16/280,848

(22) Filed: Feb. 20, 2019

(65) Prior Publication Data

US 2019/0257493 A1 Aug. 22, 2019

(30) Foreign Application Priority Data

Feb. 22, 2018 (JP) ..... 2018-030013

(51) Int. Cl.
*F21S 41/64* (2018.01)
*F21S 41/143* (2018.01)

(52) U.S. Cl.
CPC ..... *F21S 41/645* (2018.01); *F21S 41/143* (2018.01)

(58) Field of Classification Search
CPC ..... F21S 41/645; F21S 41/143
See application file for complete search history.

(56) References Cited

U.S. PATENT DOCUMENTS

2016/0169469 A1* 6/2016 Sugiyama ..... F21S 41/135 362/19
2017/0158112 A1* 6/2017 Mouri ..... B60Q 1/04
2017/0334341 A1* 11/2017 Kurashige ..... F21S 41/675
2018/0009367 A1* 1/2018 Lee ..... B60Q 1/06
2018/0009374 A1* 1/2018 Kim ..... G03B 21/206

FOREIGN PATENT DOCUMENTS

JP H06-191346 A 7/1994
JP H07-108873 A 4/1995

* cited by examiner

*Primary Examiner* — Donald L Raleigh
(74) *Attorney, Agent, or Firm* — Kenealy Vaidya LLP

(57) ABSTRACT

A method for adjusting output light color from a vehicular headlamp unit to correct the difference or change of white light of a light source by a liquid crystal element. The vehicular headlamp unit includes a light source; an information acquisition unit that acquires information in front of a own vehicle; an irradiation pattern calculation unit that determines an irradiation pattern on the basis of the information; a voltage application unit that applies a voltage to a liquid crystal element on the basis of the irradiation pattern; the liquid crystal element that changes a transmittance of each of light control regions on the basis of the voltage; and a projection optical system that performs light distribution control of light controlled to be transmitted by the liquid crystal element. The method includes adjusting color of light emitted from the vehicular headlamp unit by the voltage applied to the liquid crystal element.

5 Claims, 7 Drawing Sheets

METHOD FOR ADJUSTING OUTPUT LIGHT COLOR OF VEHICULAR HEADLAMP UNIT

This application claims the priority benefit under 35 U.S.C. § 119 of Japanese Patent Application No. 2018-030013 filed on Feb. 22, 2018, which is hereby incorporated in its entirety by reference.

TECHNICAL FIELD

The presently disclosed subject matter relates to a method for adjusting the color of output light of a vehicular headlamp unit using a liquid crystal element.

BACKGROUND ART

As a vehicular headlamp, there is known a headlamp (ADB: Adaptive Driving Beam) for controlling lighting of a travelling light (driving beam) of a headlamp of a vehicle in accordance with a condition of an oncoming or preceding vehicle in front of the vehicle.

Such a vehicular headlamp controls the light distribution state of the headlamp of the vehicle so that, when another vehicle is present in front of the vehicle, for example, the illumination is cut off only in a portion where the other vehicle is located. Such a vehicular headlamp is disclosed in, for example, Japanese Patent Application Laid-Open No. Hei. 07-108873.

Such a vehicular headlamp of the conventional example described above is provided with a camera at a predetermined position in the front part of the vehicle (for example, at the center upper part of the front window), and the vehicle body of a target vehicle (preceding vehicle or oncoming vehicle) imaged by the camera, or the position of the tail lamp or headlamp thereof is detected by image processing. Then, light distribution control is performed so that the detected portion of the preceding vehicle or the oncoming vehicle is not irradiated with light from the traveling light of the vehicle.

Japanese Patent Application Laid-Open No. Hei. 06-191346 discloses the use of a liquid crystal element for controlling the light distribution state of a headlamp.

FIG. 1 is an automobile headlamp system disclosed in Japanese Patent Application Laid-Open No. Hei. 06-191346. Reference numeral 80 denotes a light source, 81 denotes a projection unit, 82 denotes a reflecting mirror constituting the projection unit 81, 83 denotes a collimator lens constituting the same projection unit 81, 84 denotes an optical shutter that forms an optical image, 85 denotes an ultraviolet cut filter, 86 denotes an oncoming vehicle detection sensor, 87 denotes an optical shutter drive circuit, 88 denotes a light distribution control circuit, 89 denotes an attitude change detection sensor, 90 denotes a speed sensor, and 91 denotes a steering rotation angle detection sensor. In this conventional art example, liquid crystal is used as a light transmittance variable element for forming an optical image, which is provided in the optical shutter 84.

In the automobile headlamp system including the above-mentioned components, the relationship between these components and the operation thereof will be described.

Light rays emitted from the light source 80 are converted into substantially parallel light rays by the reflecting mirror 82, and are irradiated onto the optical shutter 84. Then, an optical image formed on the optical shutter 84 is projected through the collimator lens 83 onto a front road surface.

The light distribution control circuit 88, which has received the detection signals of the oncoming vehicle detection sensor 86, the attitude change detection sensor 89, the speed sensor 90, and the steering rotation angle detection sensor 91, calculates the leveling of the basic axis of the desired beam, the beam distribution, and the beam intensity in accordance with the elevation angle, the traveling speed, and the traveling direction of the vehicle, and further the presence or absence of the oncoming vehicle.

The calculated result is input to the optical shutter drive circuit 87 as an output signal, and is converted by the optical shutter drive circuit 87 into a matrix signal for forming a desired optical image on the optical shutter 84 for output. In this manner, the optical shutter 84 forms an optical image for irradiating a predetermined light distribution beam onto the front road surface with reference to the position of the basic axis of the predetermined beam, and this optical image formed on the optical shutter 84 is projected to the front road surface by the collimator lens 83.

The color (white) of the light emitted from the lamp is determined by the light source adopted. However, it is known that the color of a light source varies among individual products depending on manufacturing conditions (manufacturing lot), and also varies within the individual products due to the ambient temperature, the lifetime, and the like. In particular, since a white light source using a semiconductor light-emitting element such as a light-emitting diode (LED) is a combination of a blue light-emitting element and a yellow fluorescent material, for example, not only the characteristic change of the light-emitting element but also the characteristic change of the fluorescent material affects in combination on the color, so that the difference or change of the color of the light source becomes remarkable.

When such a lamp is used alone, the color of the light emitted from the lamp using such a light source is not felt uneasy and is often unnoticeable even if it changes. However, when a plurality of lamps are used while they are arranged side by side, the difference in color of white light between the lamps is often noticeable. Further, when a road surface light distribution is generated by combining images by a plurality of separate lamps, there arises a problem that the color of white light becomes discontinuous at the boundary of the light distribution by each lamp in addition to the appearance. Such a difference in color of white light from a light source is often increased as the use is repeated even if the difference is small in the initial stage of the just-manufactured lamp.

SUMMARY

The presently disclosed subject matter was devised in view of these and other problems and features in association with the conventional art. An object according to an aspect of the presently disclosed subject matter is to correct the difference or change of white light of a light source by using a liquid crystal element to obtain white light of a predetermined color.

According to another aspect of the presently disclosed subject matter, there is provided a method for adjusting output light color of a vehicular headlamp unit, the vehicular headlamp unit including a light source; an information acquisition unit configured to acquire information on an area in front of a vehicle on which the vehicular headlamp unit is installed; an irradiation pattern calculation unit configured to determine an irradiation pattern selective (corresponding) to the area in front of the vehicle on the basis of the information acquired by the information acquisition unit; a voltage application unit configured to apply a voltage to a liquid crystal element on the basis of the irradiation pattern determined by the irradiation pattern calculation unit; the liquid crystal element configured to have light control regions and change a transmittance of each of the light control regions on the basis of the voltage from the voltage application unit; and a projection optical system configured to perform light distribution control of light emitted from the light source and controlled to be transmitted by the liquid crystal element. The method for adjusting the output light color includes adjusting the color of light emitted from the vehicular headlamp unit by the voltage applied to the liquid crystal element.

According to this method, use of the change in the transmission spectrum of the liquid crystal element in accordance with the varied voltage applied to the liquid crystal element can adjust the spectrum of the light from the light source, whereby the color of the light emitted from the vehicular headlamp unit can be adjusted within a range that can be regarded as white light.

According to still another aspect of the presently disclosed subject matter, there is provided a method for adjusting output light color of a vehicular headlamp unit, the vehicular headlamp unit including a plurality of lamps each having an independent light source, where at least one of the plurality of the lamp includes: an information acquisition unit configured to acquire information on an area in front of a vehicle on which the vehicular headlamp unit is installed; an irradiation pattern calculation unit configured to determine an irradiation pattern selective to the front of the vehicle on the basis of the information obtained by the information acquisition unit; a voltage application unit configured to apply a voltage to a liquid crystal element on the basis of the irradiation pattern determined by the irradiation pattern calculation unit; the liquid crystal element configured to have light control regions and change a transmittance of each of the light control regions on the basis of the voltage from the voltage application unit; and a projection optical system configured to perform light distribution control of light emitted from the light source and controlled to be transmitted by the liquid crystal element. The method for adjusting the output light color includes adjusting the colors of the light emitted from the plurality of lamps to be the same color by the voltage applied to the liquid crystal element.

According to this method, use of the change in the transmission spectrum of the liquid crystal element in accordance with the varied voltage applied to the liquid crystal element can adjust the spectrum of the light from the light source, whereby the colors of the light emitted from the subject lamp and other lamps can be made uniform. This aspect of the presently disclosed subject matter is particularly useful in a vehicular headlamp unit in which a plurality of lamps are arranged side by side.

According to still another aspect of the presently disclosed subject matter, there is provided a method for adjusting output light color of a vehicular headlamp unit, the vehicular headlamp unit including a light source; an information acquisition unit configured to acquire information on an area in front of a vehicle on which the vehicular headlamp unit is installed; an irradiation pattern calculation unit configured to determine an irradiation pattern selective to the front of the vehicle on the basis of the information obtained by the information acquisition unit; a temperature detection unit configured to detect a temperature of a liquid crystal element; a storage unit configured to store in advance a relationship between the temperature detected by the temperature detection unit and a voltage applied to the liquid crystal element; a voltage application unit configured to apply a voltage to the liquid crystal element on the basis of the irradiation pattern determined by the irradiation pattern calculation unit, the temperature detected by the temperature detection unit, and the relationship stored by the storage unit; the liquid crystal element configured to have liquid control regions and change a transmittance of each of the light control regions on the basis of the voltage from the voltage application unit; and a projection optical system configured to perform light distribution control of light emitted from the light source and controlled to be transmitted by the liquid crystal element. The method for adjusting the output light color includes adjusting the color of light emitted from the vehicular headlamp unit by determining the voltage to be applied to the liquid crystal element on the basis of the temperature detected by the temperature detection unit and the relationship stored by the storage unit.

In general, it is considered that there is little difference among individual products in temperature dependence (change in characteristic value with respect to temperature change) of the light sources used and the liquid crystal elements, and therefore, a table (relationship stored in the storage unit) in which the voltage applied to the liquid crystal element with respect to each temperature is determined as a design value in advance in accordance with the temperature dependence may be used in the method according to the aforementioned aspects. In addition, there may be a case where the characteristics of the light sources and the liquid crystal elements are deviated from a predetermined value in the initial state in consideration of the difference in the characteristics of the light source and the liquid crystal element among individual products. In this case, however, it is more effective to correct the table in the initial state to use it for control.

According to another aspect of the presently disclosed subject matter, there is provided a method for adjusting output light color of a vehicular headlamp unit, the vehicular headlamp unit including: a light source; an information acquisition unit configured to acquire information on an area in front of a vehicle on which the vehicular headlamp unit is installed; an irradiation pattern calculation unit configured to determine an irradiation pattern selective to the area in front of the vehicle on the basis of the information acquired by the information acquisition unit; a voltage application unit configured to apply a voltage to a liquid crystal element on the basis of the irradiation pattern determined by the irradiation pattern calculation unit; the liquid crystal element configured to have light control regions and change a transmittance of each of the light control regions on the basis of the voltage from the voltage application unit; and a projection optical system configured to perform light distribution control of light emitted from the light source and controlled to be transmitted by the liquid crystal element. The vehicular headlamp unit further includes a color detection unit configured to detect the color of light emitted from the vehicular headlamp unit, and the method for adjusting the output light color includes: comparing the color of light detected by the color detection unit with previously stored color data; and adjusting the voltage applied to the liquid crystal element so as to keep the color of light emitted from the vehicular headlamp unit always in a predetermined color.

According to this method, it is also possible to cope with the temporal change of the color of the light source.

According to another aspect of the presently disclosed subject matter, there is provided a method for adjusting output light color of a vehicular headlamp unit, the vehicular headlamp unit including a plurality of lamps each having an independent light source, where at least one of the plurality of the lamp includes: an information acquisition unit configured to acquire information on an area in front of a vehicle on which the vehicular headlamp unit is installed; an irradiation pattern calculation unit configured to determine an irradiation pattern selective to the area in front of the vehicle on the basis of the information obtained by the information acquisition unit; a voltage application unit configured to apply a voltage to a liquid crystal element on the basis of the irradiation pattern determined by the irradiation pattern calculation unit; the liquid crystal element configured to have light control regions and change a transmittance of each of the light control regions on the basis of the voltage from the voltage application unit; and a projection optical system configured to perform light distribution control of light emitted from the light source and controlled to be transmitted by the liquid crystal element. The vehicular headlamp unit further includes a color detection unit configured to detect the color of light emitted from each of the plurality of lamps, and the method for adjusting the output light color includes: comparing the colors of light detected by the respective color detection units; and adjusting the voltage applied to the liquid crystal element so as to keep the colors of light emitted from the plurality of lamps the same color.

According to this method, it is also possible to cope with the temporal change of the color of the light source.

According to the presently disclosed subject matter, as a method for adjusting the output light color of a vehicular headlamp unit, a configuration is employed which includes: a light source, an information acquisition unit configured to acquire information on the area in front of the vehicle on which the vehicular headlamp unit is installed, an irradiation pattern calculation unit configured to determine an irradiation pattern selective to the area in front of the vehicle on the basis of the information obtained by the information acquisition unit, a voltage application unit configured to apply a voltage to a liquid crystal element on the basis of the irradiation pattern determined by the irradiation pattern calculation unit, a liquid crystal element configured to have light control regions and change the transmittance of each of the light control regions on the basis of the voltage from the voltage application unit, and a projection optical system for performing light distribution control of light emitted from the light source and controlled to be transmitted by the liquid crystal element.

With this configuration, the color of the light emitted from the vehicular headlamp unit can be adjusted by the voltage applied to the liquid crystal element, and thus, the difference or change in the white light of the light source can be corrected by using the liquid crystal element, and white light of a predetermined color can be obtained.

BRIEF DESCRIPTION OF DRAWINGS

These and other characteristics, features, and advantages of the presently disclosed subject matter will become clear from the following description with reference to the accompanying drawings, wherein.

DESCRIPTION OF EXEMPLARY EMBODIMENTS

A description will now be made below to methods for adjusting the color of light emitted from a vehicular headlamp unit of the presently disclosed subject matter with reference to the accompanying drawings in accordance with exemplary embodiments.

Figure 1:
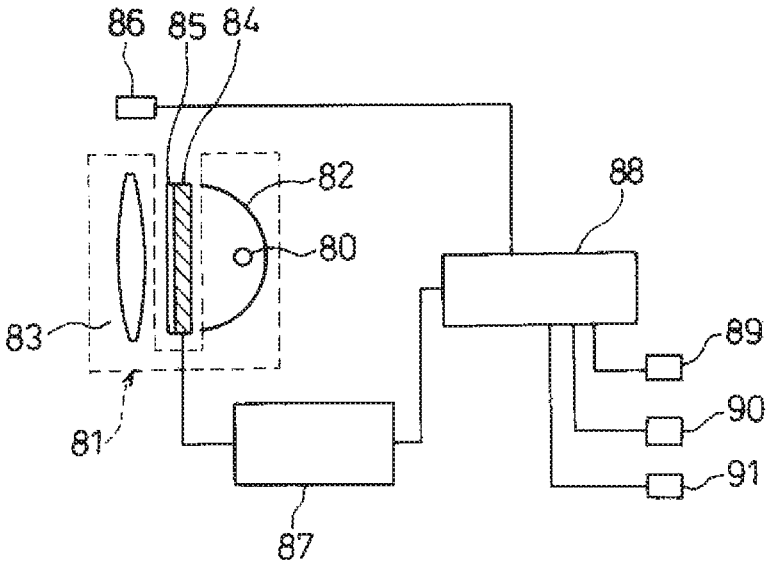
FIG. 1 Conventional Art
FIG. 1 is a diagram illustrating a conventional example of a vehicular headlamp.
Figure 2:
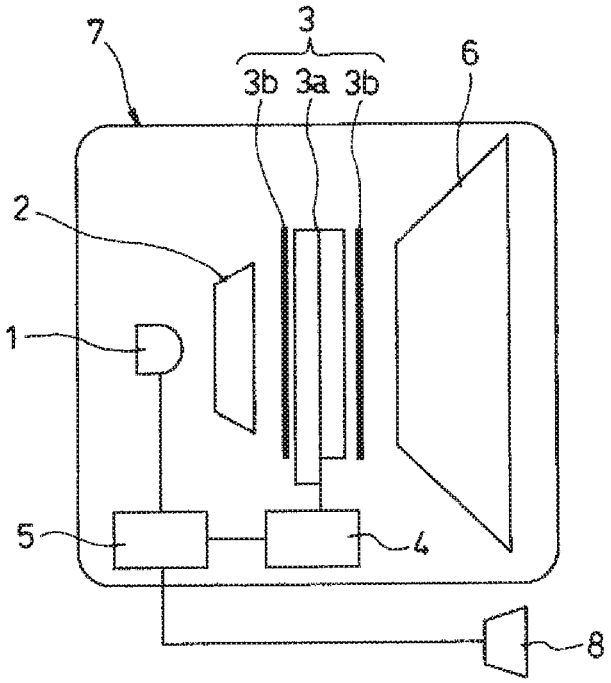
FIG. 2 is a schematic diagram illustrating a vehicular headlamp unit used in a method for adjusting the color of light emitted therefrom according to a first exemplary embodiment made in accordance with principles of the presently disclosed subject matter.

FIG. 2 is a schematic diagram illustrating a vehicular headlamp unit used in a method for adjusting the color of light emitted therefrom according to a first exemplary embodiment made in accordance with the principles of the presently disclosed subject matter. A vehicular headlamp unit may include: a light source 1 that emits white light; a parallel optical system 2 disposed in front of the light source 1 to collimate the light emitted from the light source 1; a liquid crystal element 3 disposed in front of the parallel optical system 2 to control an irradiation pattern of the output light; a projection optical system 6 disposed in front of the liquid crystal element 3 to allow the light with the irradiation pattern to pass therethrough and be projected forward; a voltage application unit 4 connected to the liquid crystal element 3 and configured to apply a voltage to the liquid crystal element 3; an irradiation pattern calculation unit 5 configured to calculate the irradiation pattern according to vehicle front information; and an information acquisition unit 8 configured to acquire information for use in controlling irradiation pattern. Hereinafter, the respective components will be described.

The light source 1 is a white LED that is formed by combining a blue LED that emits blue light and a yellow fluorescent material that is capable of being excited by blue light from the blue LED to emit fluorescence of yellow light which is complementary color to blue light.

The parallel optical system 2 is configured to include a convex lens having a focal point substantially at which the light source 1 is arranged. With this arrangement, the convex lens collimates light rays emitted from the light source 1 into parallel light rays that are to be incident on the liquid crystal element 3.

The liquid crystal element 3 includes a vertically alignment type liquid crystal cell 3*a*, and polarizers 3*b* arranged in a crossed-Nichol arrangement on both sides of the liquid crystal cell 3*a*, and is capable of responding to a voltage, i.e., being in a light-shielded state when no voltage is applied and in a transmissive state when a voltage is applied.

The liquid crystal element 3 has a plurality of light control regions, in this embodiment, 288 light control regions in the form of a matrix of six vertical divisions and 48 horizontal divisions, and is driven by a passive matrix driving with ⅙ duty cycle by the voltage application unit 4 connected to the liquid crystal element 3.

The irradiation pattern calculation unit 5 connected to the voltage application unit 4 can selectively control the states of the respective light control regions of the liquid crystal element 3 for selectively irradiating light to the area in front of the vehicle on which the vehicular headlamp unit is installed. The information acquisition unit 8 such as a camera configured to acquire information on the area in front of the vehicle is connected to the irradiation pattern calculation unit 5. The light rays emitted from the light source 1 and controlled by the liquid crystal element 3 are irradiated to the area in front of the vehicle through the projection optical system 6.

The components as described above except for the information acquisition unit 8 are housed in a housing 7 in the illustrated exemplary embodiment. In this case, the information acquisition unit 8 can be installed at the upper part of the center of a front window in order to use the information acquisition unit also as a camera used in a collision prevention braking system or the like. Thus, if a dedicated camera is used as the information acquisition unit 8, it may be installed inside the housing 7.

When the vehicular headlamp unit with the aforementioned configuration is selectively irradiating light, a control method can be applied in which an irradiation pattern in which light rays forming a light distribution to an oncoming vehicle is shielded is determined in the irradiation pattern calculation unit 5 on the basis of information on the area in front of the subject vehicle obtained from the information acquisition unit 8, for example, information on the oncoming vehicle, and a voltage is applied from the voltage application unit 4 to the respective light control regions of the liquid crystal element 3 to realize the irradiation pattern.

Since the liquid crystal element 3 of the present exemplary embodiment is a liquid crystal element capable of responding to a voltage to be in a light-shielded state at the time of no voltage application and in a transmissive state at the time of voltage application, it is only necessary to apply an off-voltage to the liquid crystal element 3 only in the light control region for the oncoming vehicle, and to apply an on-voltage to the other light control regions. Since the situation in front of the vehicle changes with time during actual traveling, the transmission/shielding state of the plurality of light control regions of the liquid crystal element 3 is also caused to change with time, and the pattern of selective light illumination is caused to change with time.

Figure 3:
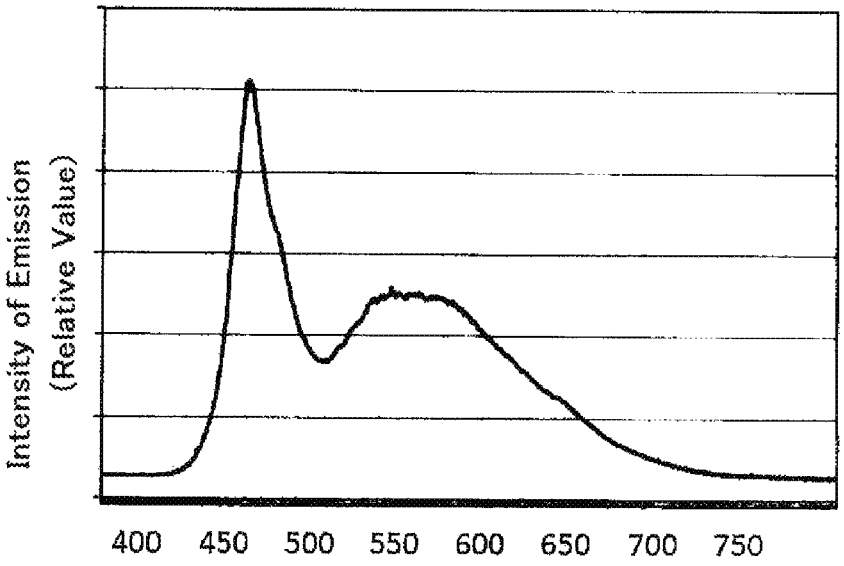
FIG. 3 shows a spectral characteristic of a light source.

FIG. 3 shows a spectral characteristic of the light source 1. As shown in FIG. 3, white light is generated by additive color mixture of light emitted from a blue LED having a wavelength of about 450 nm and fluorescence from a yellow fluorescent material that is excited by the blue light from the blue LED and emits light having a wavelength of about 500 nm to 620 nm.

Figure 4:
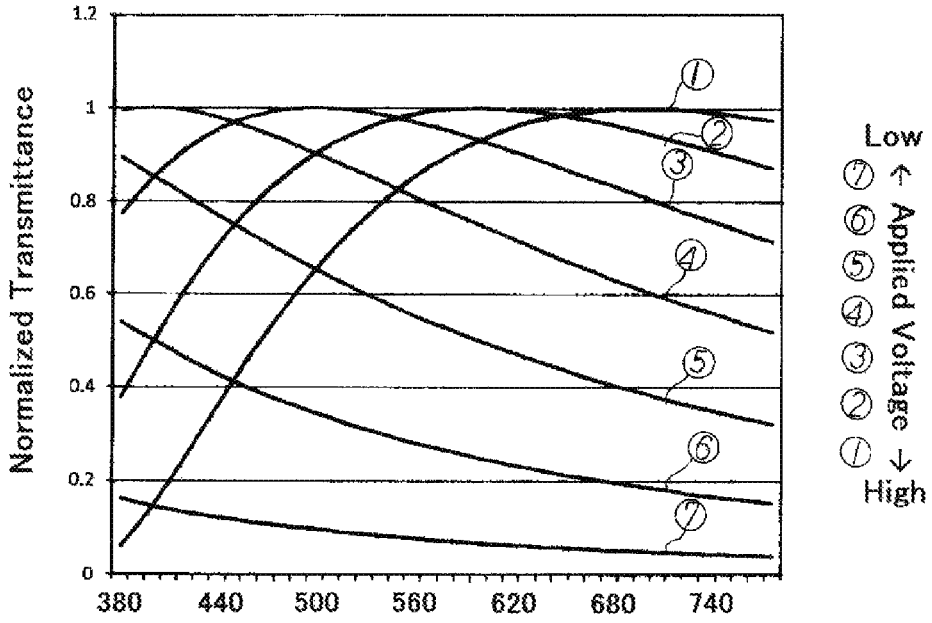
FIG. 4 is a diagram showing changes in transmission spectra relative to voltages applied to a liquid crystal element.

FIG. 4 shows the change in the transmission spectrum with respect to the applied voltages to the liquid crystal element 3. As can be seen from FIG. 4, the transmission spectrum of the liquid crystal element 3 is not flat with respect to the wavelength and has wavelength dependence. When the applied voltage is low, the transmittance is higher on the short wavelength side and the transmittance becomes higher overall as the voltage rises, but the transmission spectrum has a peak at a certain voltage or the peak moves to the long wavelength side as the voltage rises.

When an attention is given to the wavelength of the blue LED and the wavelength of the yellow fluorescent material in the above-mentioned state, the peak first occurs at the wavelength of the blue LED as the voltage rises to maximize the transmittance. Then, the peak occurs at the wavelength of the yellow fluorescent material to maximize the transmittance, as the voltage rises. After the transmittances at the respective wavelengths reach a peak, the transmittance decreases with a subsequent voltage rise.

As described above, the ratio of the transmittance of light having the wavelength of the blue LED with the spectrum of the light source 1 to the transmittance of light having the wavelength of the yellow fluorescent material to be projected through the liquid crystal element 3 can be changed by the value of the voltage applied to the liquid crystal element 3. This means that the color of the light emitted from the vehicular headlamp unit can be adjusted. Positively taking advantage of this phenomenon in the presently disclosed subject matter, the method can adjust the color of the light emitted (output light color) from the vehicular headlamp unit within the range that can be regarded as white light.

It should be noted that the irradiation pattern calculation unit 5 may comprehensively perform the control method described above and those to be described later or an independent controller configured to control these components in accordance with the above- and below-described control methods may be separately provided to the vehicular headlamp unit.

Figure 5:
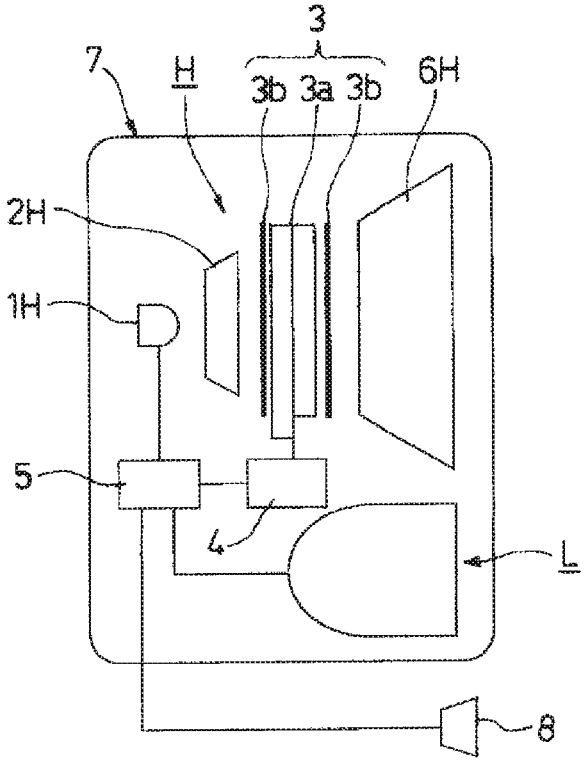
FIG. 5 is a schematic diagram illustrating a vehicular headlamp unit used in a method for adjusting the color of light emitted therefrom according to a second exemplary embodiment made in accordance with the principles of the presently disclosed subject matter.

FIG. 5 is a schematic diagram illustrating a vehicular headlamp unit used in a method for adjusting the color of light emitted therefrom according to a second exemplary embodiment made in accordance with the principles of the presently disclosed subject matter.

The difference of the second exemplary embodiment from the first exemplary embodiment is that the vehicular headlamp unit is formed of a high-beam lamp and a low-beam lamp.

In the present exemplary embodiment, the high-beam lamp has a liquid crystal element to selectively irradiate light rays to the area in front of the vehicle, and the low-beam lamp performs normal low-beam light illumination. In the present exemplary embodiment, the high-beam light distribution is generated by adding the irradiation light rays from both the high-beam lamp and the low-beam lamp.

The high-beam lamp H has a white LED light source 1H in which a blue LED emitting blue light and a yellow fluorescent material that is excited by blue light from the blue LED to emit fluorescence of yellow light which is complementary color of blue light are combined. The parallel optical system 2H is configured to include a convex lens having a focal point substantially at which the light source 1H is arranged. With this arrangement, the convex lens collimates light rays emitted from the light source 1H into parallel light rays that are to be incident on the liquid crystal element 3.

The liquid crystal element 3 includes a vertically alignment type liquid crystal cell 3*a*, and polarizers 3*b* arranged in a crossed-Nichol arrangement on both sides of the liquid crystal cell 3*a*, and is capable of responding to a voltage, i.e., being in a light-shielded state when no voltage is applied and in a transmissive state when a voltage is applied.

The liquid crystal element 3 has a plurality of light control regions, in this embodiment, 192 light control regions in the form of a matrix of four vertical divisions and 48 horizontal divisions, and is driven by a passive matrix driving with ¼ duty cycle by the voltage application unit 4 connected to the liquid crystal element 3. The light rays emitted from the light source 1H and controlled by the liquid crystal element 3 are irradiated to the area in front of the vehicle through the projection optical system 6H.

Since the low-beam lamp L may be a common low-beam lamp to conventional projection type lamps, the details of the optical system and the like thereof will not be described here.

The irradiation pattern calculation unit 5 connected to the voltage application unit 4 can selectively control the states of the respective light control regions of the liquid crystal element 3 of the high-beam lamp H for selectively irradiating light to the area in front of the vehicle on which the vehicular headlamp unit is installed.

The low-beam lamp L is also controlled to be turned on/off by the irradiation pattern control unit 5, but in most cases, the low-beam lamp is simply turned on.

The information acquisition unit 8 such as a camera configured to acquire information on the area in front of the vehicle is connected to the irradiation pattern control unit 5. The light rays emitted from the light source 1H and controlled by the liquid crystal element 3 in the high-beam lamp H are irradiated through the projection optical system 6H toward the area in front of the vehicle, and are added to the light illumination from the low beam lamp L to irradiate the front of the vehicle therewith.

Also in this exemplary embodiment, the components as described above except for the information acquisition unit 8 are housed in a housing 7. In this case, the information acquisition unit 8 can be installed at the upper part of the center of a front window in order to use the information acquisition unit also as a camera used in a collision prevention braking system or the like. Thus, if a dedicated camera is used as the information acquisition unit 8, it may be installed inside the housing 7.

Therefore, when the vehicular headlamp unit with the aforementioned configuration is selectively irradiating light as in the first exemplary embodiment, a control method can be applied in which an irradiation pattern in which light rays forming a light distribution to an oncoming vehicle is shielded is determined in the irradiation pattern calculation unit 5 on the basis of information on the area in front of the subject vehicle obtained from the information acquisition unit 8, for example, information on the oncoming vehicle, and a voltage is applied from the voltage application unit 4 to the respective light control regions of the liquid crystal element 3 for realizing the irradiation pattern.

Since the liquid crystal element 3 of the present exemplary embodiment is also a liquid crystal element capable of responding to a voltage to be in a light-shielded state at the time of no voltage application and in a transmissive state at the time of voltage application, it is only necessary to apply an off-voltage to the liquid crystal element 3 only in the light control region for the oncoming vehicle, and to apply an on-voltage to the other light control regions. Since the situation in front of the vehicle changes with time during actual traveling, the transmission/shielding states of the plurality of light control regions of the liquid crystal element 3 are also controlled to change with time, and the pattern of selective light illumination is controlled to change with time.

In the present exemplary embodiment, the high-beam lamp H of the vehicular headlamp unit performs the selective light illumination, to comprehensively achieve selective light illumination with the use of the light illumination from the low-beam lamp L.

The characteristic control of the second exemplary embodiment of the presently disclosed subject matter is to adjust the voltage applied to the liquid crystal element 3 so that the color of the light emitted from the high-beam lamp H becomes the same as the color of the light emitted from the low-beam lamp L. The principle of changing the color of the light emitted from the high-beam lamp H by the variation of the voltage applied to the liquid crystal element 3 is the same as that described in the first exemplary embodiment.

Figure 6:
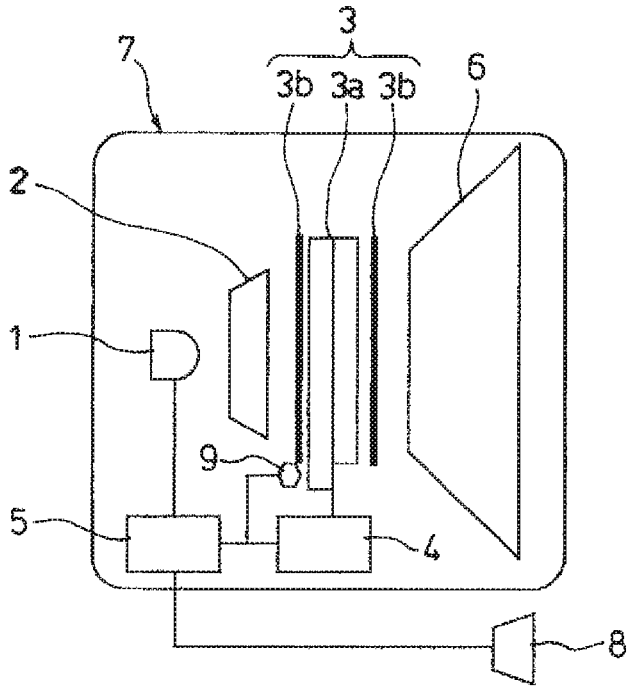
FIG. 6 is a schematic diagram illustrating a vehicular headlamp unit used in a method for adjusting the color of light emitted therefrom according to a third exemplary embodiment made in accordance with the principles of the presently disclosed subject matter.

FIG. 6 is a schematic diagram illustrating a vehicular headlamp unit used in a method for adjusting the color of light emitted therefrom according to a third exemplary embodiment made in accordance with the principles of the presently disclosed subject matter.

The difference of the third exemplary embodiment from the first exemplary embodiment is that a temperature detection unit 9 is provided in the vicinity of the liquid crystal element 3.

While the liquid crystal element 3 changes in transmission spectrum as shown in FIG. 4 depending on the applied voltage, it is known that the transmittance changes even if the temperature changes although the change is not as great as the change due to the applied voltage. This is because the birefringence of the liquid crystal decreases as the temperature rises, and the direction of the change in the transmission spectrum (shift of the peak) with respect to the temperature rises is opposite to the direction with respect to the voltage rises.

It is also known that the emission color of a white LED used as the light source changes with an increase in temperature. This is because the excitation efficiency of the fluorescent material decreases as the temperature increases, and the emission color becomes bluish as the temperature increases. Therefore, the color of the irradiated light rays of the vehicular headlamp unit becomes bluish as the temperature rises due to the change in the characteristics of the liquid crystal element and the white LED.

The characteristic control according to the third exemplary embodiment of the presently disclosed subject matter is that the color of the light emitted from the vehicular headlamp unit is adjusted and kept constant by determining the voltage to be applied to the liquid crystal element 3 on the basis of the temperature detected by the temperature detection unit 9.

Since it is considered that there is little difference among individual products in temperature dependence (change in characteristic value with respect to temperature change) of the light sources used and the liquid crystal elements, a table (relationship stored in a storage unit, which is included in the irradiation pattern calculation unit but not illustrated) in which the voltage applied to the liquid crystal element 3 with respect to each temperature is determined as a design value in advance in accordance with the temperature dependence may be used in the method. In addition, there may be a case where the characteristics of the light sources and the liquid crystal elements are deviated from a predetermined value in the initial state in consideration of the difference in the characteristics of the light source and the liquid crystal element among individual products. In this case, however, it is more effective to correct the table in the initial state to use it for control.

Figure 7:
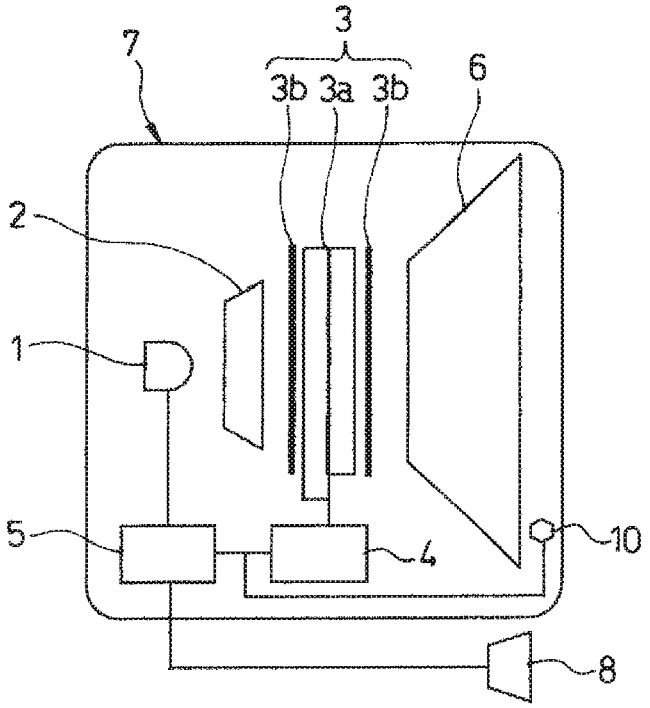
FIG. 7 is a schematic diagram illustrating a vehicular headlamp unit used in a method for adjusting the color of light emitted therefrom according to a fourth exemplary embodiment made in accordance with the principles of the presently disclosed subject matter.

FIG. 7 is a schematic diagram illustrating a vehicular headlamp unit used in a method for adjusting the color of light emitted therefrom according to a fourth exemplary embodiment made in accordance with the principles of the presently disclosed subject matter.

The difference of the fourth exemplary embodiment from the first exemplary embodiment is that a color detection unit 10 configured to detect the color of the light emitted from the vehicular headlamp unit is provided.

The characteristic control according to the fourth exemplary embodiment of the presently disclosed subject matter is to compare the color data detected by the color detection unit 10 with predetermined color data and determine the voltage to be applied to the liquid crystal element 3, thereby adjusting the color of the light emitted from the vehicular headlamp unit and keeping it constant.

Since the color of the light emitted from the vehicular headlamp unit is constantly sensed, the light source color change of the white LED due to the temperature change and the transmission spectrum change of the liquid crystal element due to the temperature change can be corrected in real time.

Figure 8:
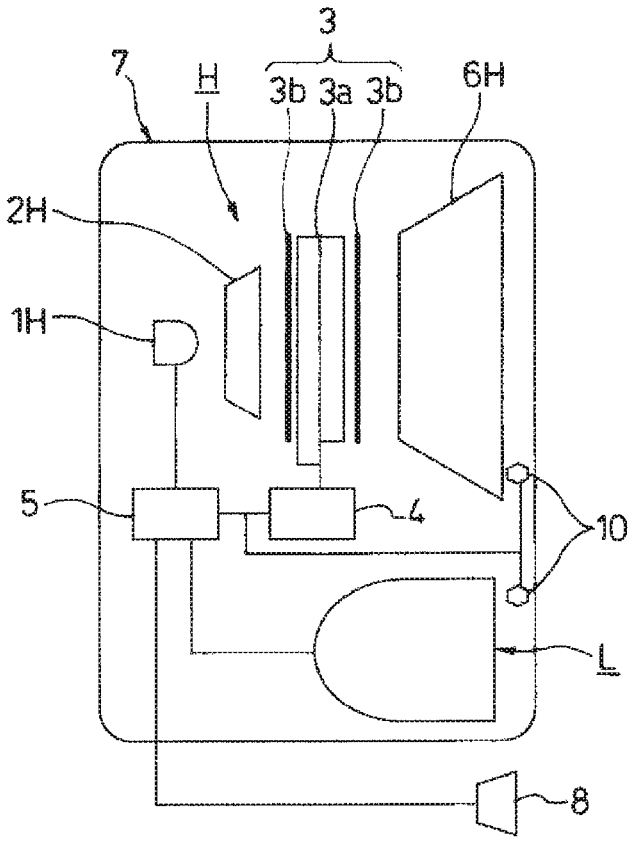
FIG. 8 is a schematic diagram illustrating a vehicular headlamp unit used in a method for adjusting the color of light emitted therefrom according to a fifth exemplary embodiment made in accordance with the principles of the presently disclosed subject matter.

FIG. 8 is a schematic diagram illustrating a vehicular headlamp unit used in a method for adjusting the color of light emitted therefrom according to a fifth exemplary embodiment made in accordance with the principles of the presently disclosed subject matter.

The difference of the fifth exemplary embodiment from the second exemplary embodiment is that color detection units 10 configured to detect the color of the light emitted from the high-beam lamp H and the low-beam lamp L are provided, respectively.

The characteristic control according to the fifth exemplary embodiment of the presently disclosed subject matter is to compare the color data detected by the color detection unit 10 disposed in the high-beam lamp H and that detected by the color detection unit 10 in the low-beam lamp L, and determine the voltage to be applied to the liquid crystal element 3, thereby keeping the colors of the light emitted from the high-beam lamp H and the low-beam lamp L, respectively, the same color.

Since the color of the light emitted from each of the high-beam lamp H and the low-beam lamp L is constantly sensed, the light source color change of the white LED due to the temperature change and the transmission spectrum change of the liquid crystal element due to the temperature change can be corrected in real time.

Although the liquid crystal elements used in the first to fifth exemplary embodiments are of the vertical alignment type, the presently disclosed subject matter is not limited thereto, and any types of liquid crystal elements such as a TN type and an STN type can be applied. Note, however, that the direction of change of the transmission spectrum with respect to the wavelength due to the applied voltage may differ depending on the type and mode (normally white or normally black) of the liquid crystal element. The color adjustment for the liquid crystal element in the normally white mode is performed by adjusting the off-voltage.

In addition, although the cases where a white LED in which a yellow fluorescent material is combined with a blue LED is used as a light source have been described, the presently disclosed subject matter is not limited to an LED light source, and can be applied to use of various white light sources such as incandescent light bulbs, halogen light bulbs, and discharge lamps.

It will be apparent to those skilled in the art that various modifications and variations can be made in the presently disclosed subject matter without departing from the spirit or scope of the presently disclosed subject matter. Thus, it is intended that the presently disclosed subject matter cover the modifications and variations of the presently disclosed subject matter provided they come within the scope of the appended claims and their equivalents. All related art references described above are hereby incorporated in their entirety by reference.

What is claimed is:

1. A method for adjusting output light color of a vehicular headlamp unit, the vehicular headlamp unit including:

a light source;

an information acquisition unit configured to acquire information on an area in front of a vehicle on which the vehicular headlamp unit is installed;

an irradiation pattern calculation unit configured to determine an irradiation pattern selective to the area in front of the vehicle on a basis of the information acquired by the information acquisition unit;

a voltage application unit configured to apply a voltage to a liquid crystal element on a basis of the irradiation pattern determined by the irradiation pattern calculation unit;

the liquid crystal element configured to have light control regions and change a transmittance of each of the light control regions on a basis of the voltage from the voltage application unit; and a projection optical system configured to perform light distribution control of light emitted from the light source and controlled to be transmitted by the liquid crystal element, the method for adjusting output light color comprising adjusting the color of light emitted from the vehicular headlamp unit by the voltage applied to the liquid crystal element.

2. A method for adjusting output light color of a vehicular headlamp unit, the vehicular headlamp unit including:

a plurality of lamps each having an independent light source, where at least one of the plurality of the lamp includes:

an information acquisition unit configured to acquire information on an area in front of a vehicle on which the vehicular headlamp unit is installed;

an irradiation pattern calculation unit configured to determine an irradiation pattern selective to the area in front of the vehicle on a basis of the information obtained by the information acquisition unit;

a voltage application unit configured to apply a voltage to a liquid crystal element on a basis of the irradiation pattern determined by the irradiation pattern calculation unit;

the liquid crystal element configured to have light control regions and change a transmittance of each of the light control regions on a basis of the voltage from the voltage application unit; and a projection optical system configured to perform light distribution control of light emitted from the light source and controlled to be transmitted by the liquid crystal element, the method for adjusting output light color comprising adjusting the colors of the light emitted from the plurality of lamps to be the same color by the voltage applied to the liquid crystal element.

3. A method for adjusting output light color of a vehicular headlamp unit, the vehicular headlamp unit including:

a light source;

an information acquisition unit configured to acquire information on an area in front of a vehicle on which the vehicular headlamp unit is installed;

an irradiation pattern calculation unit configured to determine an irradiation pattern selective to the area in front of the vehicle on a basis of the information obtained by the information acquisition unit;

a temperature detection unit configured to detect a temperature of a liquid crystal element;

a storage unit configured to store in advance a relationship between the temperature detected by the temperature detection unit and a voltage applied to the liquid crystal element;

a voltage application unit configured to apply a voltage to the liquid crystal element on a basis of the irradiation pattern determined by the irradiation pattern calculation unit, the temperature detected by the temperature detection unit, and the relationship stored by the storage unit;

the liquid crystal element configured to have liquid control regions and change a transmittance of each of the light control regions on a basis of the voltage from the voltage application unit; and a projection optical system configured to perform light distribution control of light emitted from the light source and controlled to be transmitted by the liquid crystal element, the method for adjusting output light color comprising adjusting the color of light emitted from the vehicular headlamp unit by determining the voltage to be applied to the liquid crystal element on a basis of the temperature detected by the temperature detection unit and the relationship stored by the storage unit.

4. A method for adjusting output light color of a vehicular headlamp unit, the vehicular headlamp unit including:

a light source;

an information acquisition unit configured to acquire information on an area in front of a vehicle on which the vehicular headlamp unit is installed;

an irradiation pattern calculation unit configured to determine an irradiation pattern selective to the area in front of the vehicle on a basis of the information acquired by the information acquisition unit;

a voltage application unit configured to apply a voltage to a liquid crystal element on a basis of the irradiation pattern determined by the irradiation pattern calculation unit;

the liquid crystal element configured to have light control regions and change a transmittance of each of the light control regions on a basis of the voltage from the voltage application unit;

a projection optical system configured to perform light distribution control of light emitted from the light source and controlled to be transmitted by the liquid crystal element; and a color detection unit configured to detect the color of light emitted from the vehicular headlamp unit, the method for adjusting output light color comprising: comparing the color of light detected by the color detection unit with previously stored color data; and adjusting the voltage applied to the liquid crystal element so as to keep the color of light emitted from the vehicular headlamp unit always in a predetermined color.

5. A method for adjusting output light color of a vehicular headlamp unit, the vehicular headlamp unit including a plurality of lamps each having an independent light source, where at least one of the plurality of the lamp includes:

an information acquisition unit configured to acquire information on an area in front of a vehicle on which the vehicular headlamp unit is installed;

an irradiation pattern calculation unit configured to determine an irradiation pattern selective to the area in front of the vehicle on a basis of the information obtained by the information acquisition unit;

a voltage application unit configured to apply a voltage to a liquid crystal element on a basis of the irradiation pattern determined by the irradiation pattern calculation unit;

the liquid crystal element configured to have light control regions and change a transmittance of each of the light control regions on a basis of the voltage from the voltage application unit;

a projection optical system configured to perform light distribution control of light emitted from the light source and controlled to be transmitted by the liquid crystal element; and a color detection unit configured to detect the color of light emitted from each of the plurality of lamps, the method for adjusting output light color comprising: comparing the colors of light detected by the respective color detection units; and adjusting the voltage applied to the liquid crystal element so as to keep the colors of light emitted from the plurality of lamps the same color.

* * * * *